United States Patent [19]

Lewis et al.

[11] 4,132,456

[45] Jan. 2, 1979

[54] MERCHANDISE MULTIPLYING DISPLAY

[75] Inventors: David G. A. Lewis; Michael G. Connolly, both of Darlington, England

[73] Assignee: Dacon Display Services Limited, England

[21] Appl. No.: 730,460

[22] Filed: Oct. 7, 1976

[51] Int. Cl.[2] ..... A47B 77/08

[52] U.S. Cl. ..... 312/223; 312/224; 312/225

[58] Field of Search ..... 312/224, 225

[56] References Cited

U.S. PATENT DOCUMENTS

| | | | |
|---|---|---|---|
| 1,575,988 | 3/1926 | Möller | 312/225 |
| 2,346,368 | 4/1944 | Edwards | 312/224 |
| 2,628,877 | 2/1953 | Woo | 312/225 |
| 2,703,743 | 3/1955 | Harwood | 312/225 |
| 3,032,905 | 5/1962 | Schultz | 312/224 |
| 3,334,952 | 8/1967 | Brach | 312/224 |

*Primary Examiner*—Paul R. Gilliam
*Attorney, Agent, or Firm*—Steinberg & Blake

[57] ABSTRACT

A display device for multiplying images of a sample to give an impression of a full wall or floor covering. In a first version, a tray is surrounded with four mirrors at right angles to each other and located in a cabinet with a viewing window in one side for viewing multiple images of a sample on the tray reflected in the mirrors. In a second version, two parallel vertical mirrors are disposed at right angles to a vertical support arranged between them, one of the mirros being slidable on runners. In both embodiments, lamps are provided for simulating the effects of different illuminations.

12 Claims, 4 Drawing Figures

MERCHANDISE MULTIPLYING DISPLAY

This invention relates to a merchandise multiplying display.

An object of the invention is to present a view of a large area from an available space sufficient only for one or several objects forming a part of the view it is desired to display.

In displaying wallpaper, samples are mounted in book form for inspection by customers who wish the room to be decorated by their purchase. From the samples they can only see a little more than two square feet and even when a roll of wallpaper is unfurled, or in this way displayed on screens, the area seen is less than enough to display the appearance of the design printed on the paper as it would appear when applied over a wall of the room.

According to the invention a viewing display device comprises a frame supporting opposed spaced apart mutually parallel reflecting surfaces and a further support for mounting an objection for reflection in the surfaces.

Preferred embodiments of the invention will now be described by way of example, with reference to the accompanying drawings, wherein.

Figure 1:
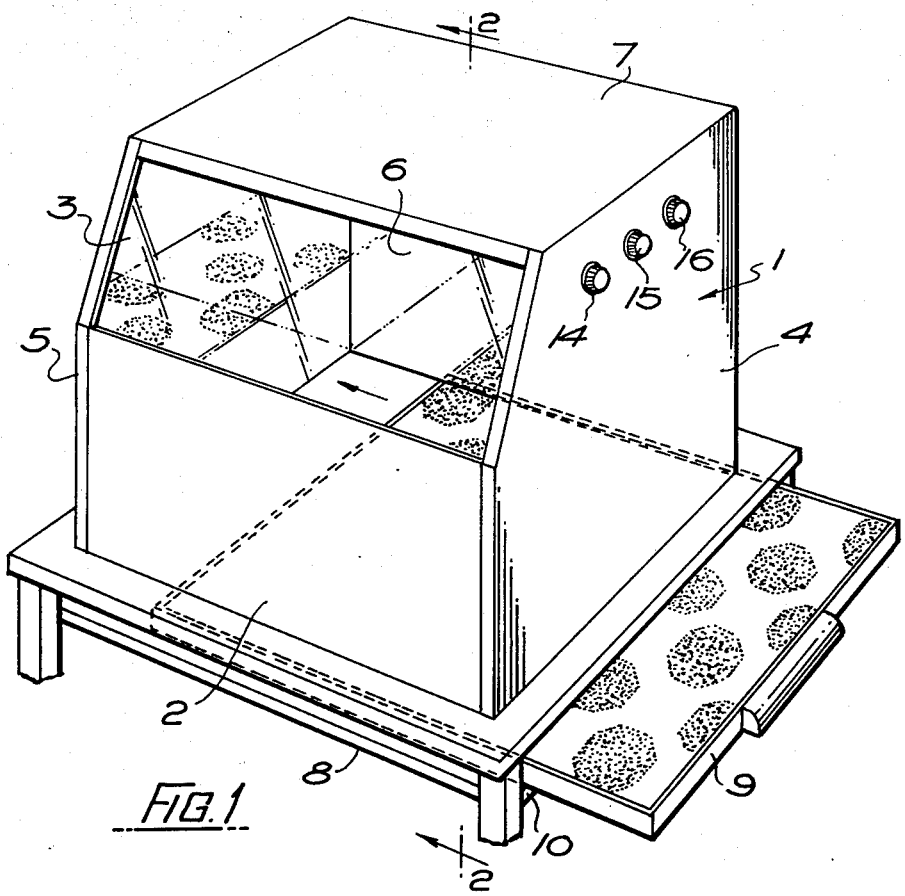
FIG. 1 is a perspective view of a first embodiment of device according to the invention.
Figure 2:
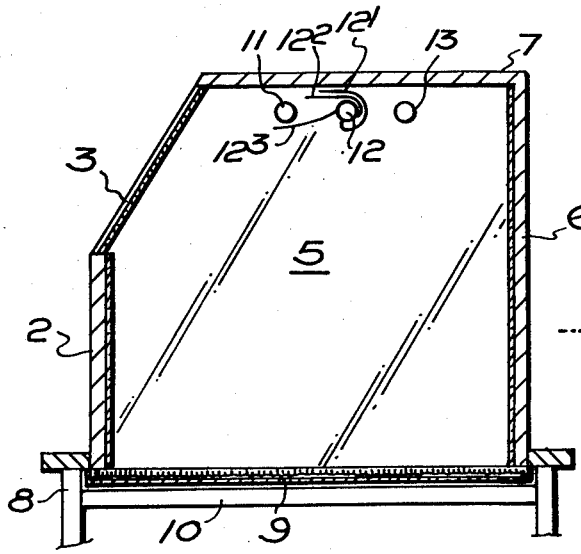
FIG. 2 is a sectional view of the device of FIG. 1 on line 2—2.

A first embodiment of display device according to the invention, designed for displaying floor coverings such as carpets, carpet tiles, or floor-tiles, linoleum and linoleum tiles, is shown in FIGS. 1 and 2. The device comprises a generally box shaped cabinet 1, having a front wall 2 with an inclined glazed viewing window 3. (This window may be glazed with a transparent plastics material), side walls 4,5 a rear wall 6, a top 7 and a legged base 8. The front, side and rear walls 2,4,5 and 6 are each lined internally with a reflecting surface, either conventional back silvered mirrors, or more preferably front silvered mirrors, so that the depth of the glass of the mirror does not become conspicuous in the multipled images. A flat bed tray 9 is received in the bottom of the cabinet, resting on struts on the base 8 and is removable and insertable through a slot 10 in the base 8. The tray 9 is to carry a sample, e.g. a standard size carpet sample, 27 inches square, and the dimensions of the cabinet are set in accordance with the size of the sample to be displayed. The mirrors and tray are all mutually perpendicular, opposed mirrors being parallel.

Three lamps 11,12,13 are carried adjacent the top part 7 of the cabinet, one being a fluorescent white light emitter, a second a yellow light emitter, and a third a pale blue light emitter. Each lamp is positioned with reflectors between the lamp and the top 7 of one cabinet to illuminate the sample resting on tray 9. The different lamps being controlled by switch knobs 14,15 and 16 to demonstrate the appearance of the sample in day light, ordinary incandescent electric light, and mood lighting by means of variously coloured filters $12^1$, $12^2$, $12^3$ may be provided e.g. on a rotary disc placed on the path of light from lamp 12.

It will be appreciated, that when a sample is placed on the tray 9, and is illuminated by one of the lamps 11, 12 or 13, a viewer looking through the window 3 will see not only the sample, but images of the sample, multiplied by the all-around mirrors, giving an impression of a large area of floor covered with a complete carpet in the pattern of the sample. The viewer is therefor better able to judge the appearance of an intended purchase than is practicable solely from a small sample.

As is apparent from FIG. 2 in particular, the tray 9 forms a support means for supporting the sample sheet material in such a way that the latter directly engages the lower edges of the mirrors, so that there is no gap between the sheet-material sample and the mirrors with the latter thus providing images which appear to be continuous extensions of the sample.

Figure 3:
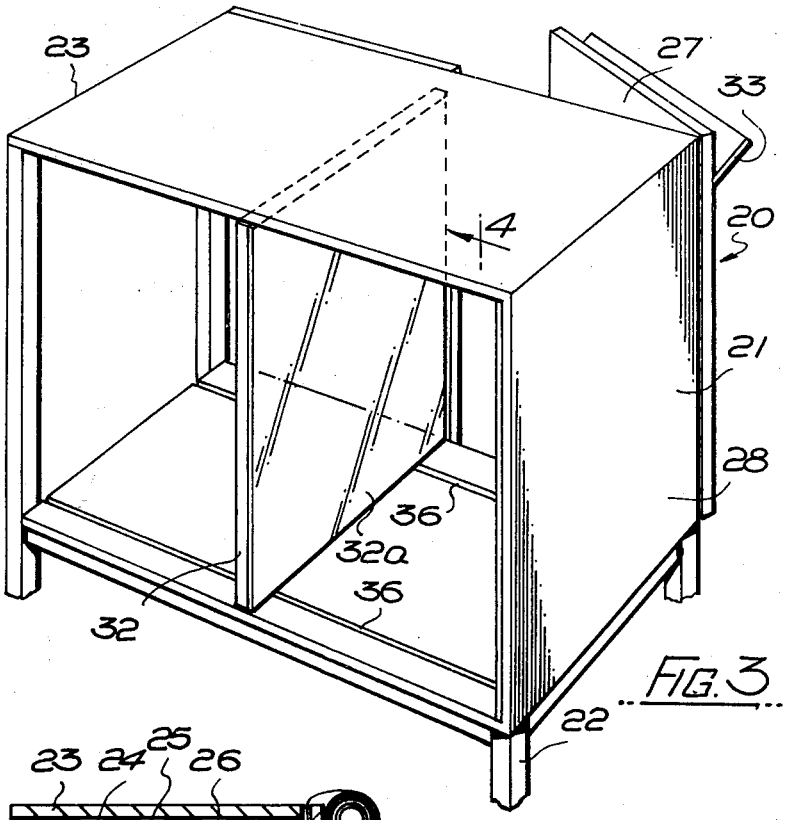
FIG. 3 is a perspective view of a second embodiment; of device according to the invention.
Figure 4:
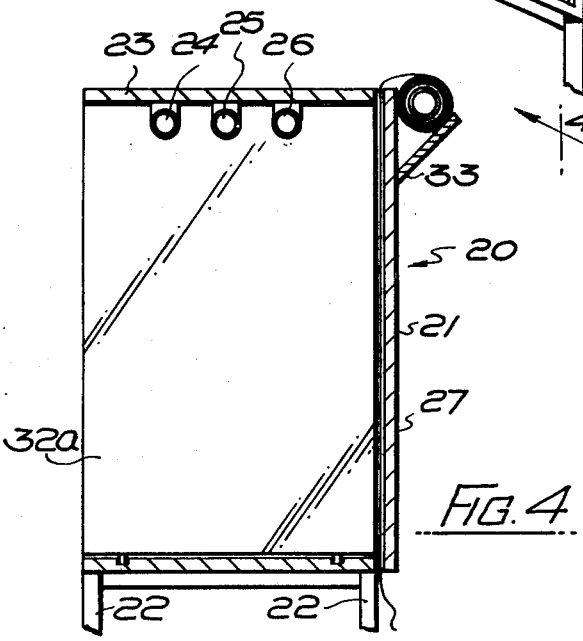
FIG. 4 is a sectional view of the device of FIG. 3 on line 4—4.

The second embodiment of display device according to the invention (FIGS. 3 and 4) is intended for the display of wall coverings such as wall paper. A display device 20 comprises a double open fronted cabinet 21, supported on a plinth or table 22. The cabinet has a top 23, by which are carried three lamps 24,25 and 26. These lamps are of the same kinds as the lamps 11,12,13 in the first embodiment. Two vertical back walls 27 are each hinged at one side to provide access and has means whereby a sheet of wall paper can be suspended flat against the inner surface of the wall 27. The cabinet 21 has a side wall 28 and an open front side through which the interior of the cabinet may be viewed, side wall 28 being lined at its inner vertical surface with a mirror which is arranged vertically perpendicular to the back wall 27 in its closed position. A central wall 32 has a mirror **32*a* parallel to and facing the mirror which lines the inner surface of the wall 28**.

In use, a sample of wall paper is secured flat against the inner surface of one wall 27, and a viewer standing at the open side of the cabinet 21 can see the image of the sheet of paper multiplied many times by multiple reflections between the mirrors respectively lining the inner surfaces of the walls 28 and 32. A ledge 33 is provided to support a roll of paper so that a part thereof extends over the top edge of wall 27 downwardly along the inner surface thereof and hangs flat against this inner surface of the wall 27. It is therefore possible to assess the appearance of a complete wall covered with the paper; which is difficult to visualise from a single piece.

The mirrors are 21 inches apart, the standard width of wallpaper, but one mirror, namely the mirror **32*a* may be adjusted for non-standard widths on runners 36 for double widths. The centre wall 32** is moved to abut the frame forming the open front through which the interior of the cabinet is viewed.

The area of the sample in the first embodiment may also be variable by movement of the mirrors to accommodate variously sized pieces of floor coverings such as carpet tiles, linoleum etc.

The invention can also be adapted to display ceiling covers such as ceiling tiles by having a flat bed holder on the top of a cabinet generally similar to the first embodiment, illuminated from below with the mirrors adjusted to a space of 30 cm square or 60 cm square.

We claim:

1. In a display device for displaying a sheet-material sample in such a way that it appears to extend over an area greater than that of the sample, cabinet means having a hollow interior and formed with a viewing opening through which the hollow interior of the cabinet means may be viewed, said cabinet means including at least one pair of parallel walls which are spaced from each other and which have inner, flat, parallel, light-reflecting, image-forming surfaces facing each other and defining part of the hollow interior of said cabinet means, and said cabinet means also including a support means situated adjacent said walls for removably supporting a flat sheet-material sample in a position extending between said walls directly next to edges thereof in a plane perpendicular to parallel planes occupied by said image-forming surfaces thereof, in such a way that images of the sheet-material sample provided by said image-forming surfaces appear to form extensions of the sample, so that a viewer viewing the interior of said cabinet means through said viewing opening thereof will see the sample and the images thereof formed by said image-forming surfaces so as to achieve from the sample the effect which would be provided by the sample when extended over an area greater than that actually occupied by the sample.

2. The combination of claim 1 and wherein said walls are vertical.

3. The combination of claim 2 and wherein said support means supports the sheet-material sample in a horizontal plane.

4. The combination of claim 3 and wherein said cabinet means includes a second pair of vertical walls extending between the first-mentioned pair of vertical walls and also having inner flat light-reflecting, image-forming surfaces spaced from and facing each other, the latter surfaces extending perpendicularly across the image-forming surfaces of the first pair of walls and also having edges next to which the sheet-material sample is situated by said support means, so that the hollow interior of the cabinet means is partly surrounded by the image-forming surfaces of all four walls, said viewing opening of said cabinet means affording a view directed toward said support means and a sample supported thereby, so that the images extend the area which appears to be occupied by the sample in a pair of mutually perpendicular directions.

5. The combination of claim 4 and wherein said support means is situated beneath said walls for removably supporting a sheet-material sample in engagement with bottom edges of said walls.

6. The combination of claim 5 and wherein said viewing opening is situated in a plane which is situated over and inclined with respect to the horizontal plane in which the sample is supported by said support means.

7. The combination of claim 6 and wherein a transparent glass sheet covers said viewing opening.

8. The combination of claim 6 and wherein said support means is in the form of a removable tray which carries said sample.

9. The combination of claim 2 and wherein said support means supports said sheet-material sample in a vertical plane which is situated opposite the viewing opening of said cabinet means.

10. The combination of claim 9 and wherein said cabinet means includes an adjusting means for adjustably supporting one of said walls for movement toward and away from the other of said walls so as to adjust the distance between said walls to the width of the sheet-material sample.

11. The combination of claim 9 and wherein said support means is in the form of a wall of said cabinet means which is hingedly mounted for swinging movement to and from a position supporting a sheet-material sample in a plane perpendicular to and extending across said pair of parallel walls.

12. The combination of claim 11 and wherein said wall of said support means carries adjacent an edge an exterior ledge on which a roll of wall paper may be supported with a portion of the wall paper extending along and lying flat against an inner surface of the wall of said support means.

* * * * *